US008215031B2

(12) United States Patent
Kimura et al.

(10) Patent No.: US 8,215,031 B2
(45) Date of Patent: Jul. 10, 2012

(54) SOLE STRUCTURE FOR A SHOE

(75) Inventors: Takaya Kimura, Kobe (JP); Koji Ito, Takaishi (JP); Natsuki Sato, Kawanishi (JP)

(73) Assignee: Mizuno Corporation, Osaka-shi (JP)

( * ) Notice: Subject to any disclaimer, the term of this patent is extended or adjusted under 35 U.S.C. 154(b) by 580 days.

(21) Appl. No.: 12/380,462

(22) Filed: Feb. 27, 2009

(65) Prior Publication Data

US 2009/0241371 A1 Oct. 1, 2009

(30) Foreign Application Priority Data

Mar. 31, 2008 (JP) ..... 2008-091737

(51) Int. Cl.
*A43B 13/18* (2006.01)
*A43B 13/20* (2006.01)
*A43B 21/24* (2006.01)

(52) U.S. Cl. ..... 36/28; 36/29; 36/35 R

(58) Field of Classification Search ..... 36/28, 29, 36/35 R, 27, 59 R, 25 R
See application file for complete search history.

(56) References Cited

U.S. PATENT DOCUMENTS

| | | | | |
|---|---|---|---|---|
| 1,625,810 | A * | 4/1927 | Krichbaum | 156/192 |
| 1,916,483 | A * | 7/1933 | Krichbaum | 2/88 |
| 2,748,401 | A * | 6/1956 | Winstead | 5/655.3 |
| 5,022,109 | A * | 6/1991 | Pekar | 5/706 |
| 5,337,492 | A * | 8/1994 | Anderie et al. | 36/28 |
| 5,713,140 | A * | 2/1998 | Baggenstoss | 36/28 |
| 5,890,245 | A * | 4/1999 | Klearman et al. | 5/714 |
| 6,769,202 | B1 * | 8/2004 | Luthi et al. | 36/28 |
| 7,484,317 | B2 | 2/2009 | Kita et al. | |
| 7,549,236 | B2 * | 6/2009 | Dillon et al. | 36/30 R |
| 2006/0265902 | A1 | 11/2006 | Kita et al. | |
| 2008/0289224 | A1 * | 11/2008 | Sink | 36/103 |
| 2009/0282700 | A1 * | 11/2009 | Dillon et al. | 36/88 |
| 2010/0205829 | A1 * | 8/2010 | Schindler et al. | 36/28 |
| 2011/0138652 | A1 * | 6/2011 | Lucas et al. | 36/28 |

FOREIGN PATENT DOCUMENTS

| | | |
|---|---|---|
| JP | 11-235202 | 8/1999 |
| JP | 2003-339405 | 12/2003 |
| WO | WO 2006/129837 | 12/2006 |

* cited by examiner

*Primary Examiner* — Ted Kavanaugh
(74) *Attorney, Agent, or Firm* — W. F. Fasse

(57) ABSTRACT

A sole structure 1 for a shoe comprises an upper sheet portion 2 disposed on the upper side of the sole structure, and a plurality of curved sheet portions 3 ($3_1$-$3_5$) that are provided on the lower surface of the upper sheet portion 2, that have downwardly convexedly curved portions 31-35, respectively, and that are disposed side by side and partially overlapped with each other in the longitudinal direction. Each of the curved sheet portions $3_1$-$3_5$ has a first end A ($A_1$-$A_5$) and a second end B ($B_1$-$B_5$) on the opposite sides of each of the downwardly convexedly curved portions 31-35. The first end A of the curved sheet portion 3 is located on the front side of the sole structure 1 and fixed to the lower surface of the upper sheet portion 2. The second end B of the curved sheet portion 3 is located on the rear side of the sole structure 1 and fixed to the external surface of the adjacent curved sheet portion 3.

25 Claims, 7 Drawing Sheets

SOLE STRUCTURE FOR A SHOE

BACKGROUND OF THE INVENTION

The present invention relates generally to a sole structure for a shoe, and more particularly, to an improved sole structure for enhancing cushioning properties and controlling a load transfer during running.

We proposed a sole structure for a shoe such as shown in Japanese patent application laying-open publication No. 11-235202 (JP 11-235202). The sole structure is comprised of a plurality of band-shaped wavy corrugated sheets arranged side by side and connections that connect the adjacent wavy corrugated sheets with each other.

Also, Japanese patent application laying-open publication No. 2003-339405 (JP 2003-339405) shows a sole structure for a shoe composed of an upper plate and a lower plate that are disposed oppositely to each other via a void in the upper and lower direction, and a wavy corrugated plate that is interposed between the upper plate and the lower plate and that has an upwardly convex surface fixedly attached to the upper plate and a downwardly convex surface fixedly attached to the lower plate.

Further, WO 2006/129837 shows a sole structure for a shoe composed of an upper plate, a wavy corrugated lower plate disposed under the upper plate and having two bulges that form a void with the upper plate, and an elastic block member that couples an upwardly convex portion formed between the two bulges to the upper plate.

In the above-mentioned sole structure shown in JP 11-235202, when the shoe strikes onto the ground, each of wavy corrugated portions of the band-shaped wavy corrugated sheets compressively deforms into a more flattened shape and at this juncture each of the connections is twisted by each of the wavy corrugated portions to function as a torsion bar. As a result, in conjunction with the deformation of each of the wavy corrugated portions of the wavy corrugated sheets, an impact load is absorbed.

However, in this case, since the adjacent band-shaped wavy corrugated sheets are coupled to each other by the connections, the amount of compressive deformation of the wavy corrugated portions of the band-shaped wavy corrugated sheets is restricted.

Also, in the above-mentioned sole structure shown in JP 2003-339405, at the time of the shoe strike onto the ground, each of the wavy corrugated portions of the wavy corrugated plate compressively deforms into a more flattened shape and the void between the upper plate and the lower plate thus acts as a cushioning hole to absorb the impact load.

However, in this case, since the upwardly convex surface of the wavy corrugated plate is fixedly attached to the upper plate and the downwardly convex surface of the wavy corrugated plate is fixedly attached to the lower plate. The upwardly and downwardly convex surfaces of the wavy corrugated plate are thus restrained by the upper and lower plates. Thereby, the amount of compressive deformation of the wavy corrugated portions of the wavy corrugated plate is restricted.

Further, in the above-mentioned sole structure shown in WO 2006/129837, at the time of the shoe strike onto the ground, each of the bulges of the lower plate compressively deforms into a more flattened shape and the void between the upper and lower plates thus functions as a cushioning hole to absorb the impact load.

In this case, as compared with the sole structures of JP 11-235202 and JP 2003-339405, since the upwardly convex portion between the adjacent bulges of the lower plate is coupled to the upper plate through the elastic block member the compressive deformation of each of the bulges is relatively facilitated and the cushioning properties are improved.

However, in this case, each of the bulges is so constructed as to compressively deform independently and the amount of compressive deformation of each of the bulges depends on the rigidity of each of the bulges. Consequently, the prior art sole structure has a certain limitation in improving the cushioning properties of the entire sole structure.

On the other hand, there exists a demand in the shoe industry that they want to control a load transfer during running to further improve a ride feeling.

The present invention is directed to providing a sole structure for a shoe that can facilitate a compressive deformation to improve the cushioning properties and also that can control a load transfer during running.

Other objects and advantages of the present invention will be obvious and appear hereinafter.

SUMMARY OF THE INVENTION

A sole structure for a shoe according to a first aspect of the present invention comprises an upper sheet portion disposed on an upper side of the sole structure, and a plurality of curved sheet portions that are provided on a lower surface of the upper sheet portion, that have downwardly convexedly curved portions, respectively, and that are disposed side by side and partially overlapped with each other in the longitudinal direction. Each of the curved sheet portions has a first end and a second end on opposite sides of each of the downwardly convexedly curved portions. The first end of each of the curved sheet portions is fixed to the lower surface of the upper sheet portion, and the second end of each of the curved sheet portions is fixed to an external surface of the adjacent curved sheet portion.

According to the first aspect of the present invention, when the shoe strikes onto the ground, the downwardly convexedly curved portions of the curved sheet portions compressively deform to absorb a shock load. Also, when the curved sheet portions have compressively deformed, the second ends of the curved sheet portions press against and compressively deform the external surfaces of the adjacent curved sheet portions.

In such a manner, the compressive deformation of the adjacent curved sheet portions is caused by the compressive deformation of any of the curved sheet portions, thereby improving cushioning properties of the entire sole structure.

Moreover, in the event that for each of a plurality of the curved sheet portions the first end is located on the front side of the sole structure and the second end is located on the rear side of the sole structure, when the load is transferred from the rear side to the front side of the sole structure, a region extending from the downwardly convexedly curved portion of each of the curved sheet portions to the first end deforms in such a way as to be folded up in turn toward the front side. As a result, a smooth load transfer toward the front side during running can be achieved to improve a ride feeling during running.

To the contrary, in the event that for each of a plurality of the curved sheet portions the first end is located on the rear side of the sole structure and the second end is located on the front side of the sole structure, when the load is transferred from the rear side to the front side of the sole structure, a region extending from the downwardly convexedly curved portion of each of the curved sheet portions to the first end deforms in such a way as to be folded up toward the rear side, thereby breaking down a load transfer toward the front side during running. As a result, the load transfer in the forward direction can be controlled.

A sole structure for a shoe according to a second aspect of the present invention comprises an upper sheet portion disposed on an upper side of the sole structure and first to third curved sheet portions that are provided on a lower surface of the upper sheet portion, that have downwardly convexedly curved portions, respectively, and that are disposed side by side and partially overlapped with each other in the longitudinal direction. Each of the first to third curved sheet portions has a first end and a second end on opposite sides of each of the downwardly convexedly curved portions. The first end of each of the first to third curved sheet portions is fixed to the lower surface of the upper sheet portion. The second end of the first curved sheet portion is fixed to an external surface of the second curved sheet portion adjacent to the first curved sheet portion. The second end of the second curved sheet portion is fixed to an external surface of the third curved sheet portion adjacent to the second curved sheet portion.

According to the second aspect of the present invention, when the shoe strikes onto the ground, the downwardly convexedly curved portions of the curved sheet portions compressively deform to absorb a shock load. Also, when any of the curved sheet portions, e.g. the first curved sheet portion, has compressively deformed, the second end portion of the first curved sheet portion presses against and compressively deforms the external surface of the second curved sheet portion adjacent to the first curved sheet portion. Also, when the second curved sheet portion has compressively deformed, the second end portion of the second curved sheet portion presses against and compressively deforms the external surface of the third curved sheet portion adjacent to the second curved sheet portion.

In such a manner, the compressive deformation of any of the adjacent curved sheet portions causes the compressive deformation of the adjacent curved sheet portions, thereby improving cushioning properties of the entire sole structure.

Moreover, in the event that for each of the first to third curved sheet portions the first end is located on the front side of the sole structure and the second end is located on the rear side of the sole structure, when the load is transferred from the rear side to the front side of the sole structure, a region extending from the downwardly convexedly curved portion of the first to third curved sheet portions to the first end deforms in such a way as to be folded up in turn toward the front side. As a result, a smooth load transfer toward the front side during running can be achieved to improve a ride feeling during running.

To the contrary, in the event that for each of the first to third curved sheet portions the first end is located on the rear side of the sole structure and the second end is located on the front side of the sole structure, when the load is transferred from the rear side to the front side of the sole structure, a region extending from the downwardly convexedly curved portion of each of the first to third curved sheet portions to the first end deforms in such a way as to be folded up toward the rear side, thereby breaking down a load transfer toward the front side during running. As a result, a load transfer in the forward direction can be controlled.

The second end of each of the curved sheet portions may be fixed to a position between the lowermost point of the downwardly convexedly curved portion of the adjacent curved sheet portion and the first end of the adjacent curved sheet portion.

In this case, when the second end of the compressively deformed curved sheet portion presses against the external surface of the adjacent curved sheet portion, the adjacent curved sheet portion deforms with ease. Thereby, the cushioning properties of the entire sole structure can be improved.

The adjacent curved sheet portion that the second end of each of the curved sheet portions is fixed to may extend over the lowermost point of the downwardly convexedly curved portion of each of the curved sheet portions in the substantially longitudinal direction.

In this case, a load acting on the lowermost point of the downwardly convexedly curved portion of each of the curved sheet portions can be sustained by at least two curved sheet portions of the curved sheet portion and the adjacent curved sheet portion. The shock absorbing ability can thus be enhanced.

The sole structure may be constructed such that at the time of the compressive deformation of the sole structure the curved sheet portions compressively deform and the second end of each of the compressively deformed curved sheet portions presses against and compressively deforms the adjacent curved sheet portion.

In this case, the compressive deformation of any of the curved sheet portions causes the compressive deformation of the adjacent curved sheet portions, thereby securely improving the cushioning properties of the entire sole structure.

The first end of each of the curved sheet portions may be located on the front side of the sole structure and the second end of each of the curved sheet portions may be located on the rear side of the sole structure.

In this case, as the load is transferred from the rear side to the front side of the sole structure, a region extending from the downwardly convexedly curved portion of each of the curved sheet portions to the first end deforms in such a way as to be folded up in turn toward the front side. As a result, a smooth load transfer toward the front side during running can be achieved to improve a ride feeling during running.

The first end of each of the curved sheet portions may be located on the rear side of the sole structure and the second end of each of the curved sheet portions may be located on the front side of the sole structure.

In this case, as the load is transferred from the rear side to the front side of the sole structure, a region extending from the downwardly convexedly curved portion of each of the curved sheet portions to the first end deforms in such a way as to be folded up toward the rear side, thereby breaking down a load transfer toward the front side during running. As a result, a load transfer in the forward direction can be controlled.

The sole structure may be provided at a heel region of the shoe.

In this case, a compressive deformation of the heel region is facilitated to improve the cushioning properties and also a load transfer of the heel region during running can be controlled.

The sole structure may be provided at a forefoot region of the shoe.

In this case, a compressive deformation of the forefoot region is facilitated to improve the cushioning properties and also a load transfer of the forefoot region during running can be controlled.

The sole structure may be provided at the entire sole surface of the shoe.

In this case, a compressive deformation of the entire sole surface is facilitated to improve the cushioning properties and also a load transfer of the entire sole surface of the heel region to the toe during running can be controlled The sole structure may be provided at the heel region to the forefoot region of the shoe and a discontinuity may be provided at a part of the sole structure.

Here, "discontinuity" means a part having a different shape from each of the curved sheet portions provided in front of and at the rear of the part. For example, "discontinuity" may be an upwardly convexedly curved part (or a flat shaped part) interposed between and interconnecting the adjacent curved sheet portions. Alternatively, "discontinuity" may be a downwardly convexedly curved part interposed between and interconnecting the adjacent curved sheet portions, the first and second ends of the part being fixed to the upper sheet portion.

In this case, as the weight moves from the heel region through the discontinuity to the forefoot region of the sole structure, for the heel region to the discontinuity, a region extending from the downwardly convexedly curved portion of each of the curved sheet portions to the first end deforms so as to be folded up in turn toward the front side and a smooth load transfer in the forward direction during running can be achieved. However, at the discontinuity, because the curved sheet portion is restricted from being deformed, a load transfer in the forward direction during running is broken down. Thereafter, as the weight moves from the discontinuity to the forefoot portion, a region extending from the downwardly convexedly curved portion of each of the curved sheet portions to the first end deforms so as to be folded up in turn toward the rear side to the front side and a smooth load transfer during running can thus be achieved.

In such a way, a load transfer from the heel region to the forefoot region during running can be controlled more minutely and the sole structure according to the kinds of sports can be achieved.

The sole structure may be provided at the heel region to the forefoot region of the shoe and a discontinuity may be provided at a part of the sole structure.

In this case, as the weight moves from the heel region through the discontinuity to the forefoot region of the sole structure, for the heel region to the discontinuity, a region extending from the downwardly convexedly curved portion of each of the curved sheet portions to the first end deforms so as to be folded up toward the rear side and a load transfer in the forward direction during running is broken down. However, at the discontinuity, because the curved sheet portion is restricted from being deformed, a braking-down power relative to the forward load transfer is lowered. Thereafter, as the weight moves from the discontinuity to the forefoot region, a region extending from the downwardly convexedly curved portion of each of the curved sheet portions to the first end deforms so as to be folded up in turn toward the rear side, thereby breaking down a load transfer toward the front side during running.

In such a manner, a load transfer from the heel region to the forefoot region during running can be controlled more minutely and the sole structure according to the kinds of sports can be achieved.

The discontinuity may be formed of a connecting sheet portion that connects the sole structure on the forefoot region with the sole structure on the rear foot region in the longitudinal direction.

In this case, since the connecting sheet portion can prevent the upper sheet portion from sinking or going down, it lifts up and sustains an arch portion of the shoe during running to exhibit an shank effect.

The sole structure according to a third aspect of the present invention may be formed of a first sole structure provided at the rear foot region of the shoe and a second sole structure provided at the forefoot region of the shoe. The first sole structure may be constructed such that the first end is located on the front side of the sole structure and the second end is located on the rear side of the sole structure, and the second sole structure may be constructed such that the first end is located on the rear side of the sole structure and the second end is located on the front side of the sole structure.

According to the third aspect of the present invention, as the weight moves from the rear side to the front side of the rear foot region of the sole structure, a region extending from the downwardly convexedly curved portion of each of the curved sheet portions to the first end deforms in such a way as to be folded up in turn toward the front side. Thereby, a smooth load transfer in the forward direction during running can be achieved. On the other hand, as the weight moves from the rear side to the front side of the forefoot region of the sole structure, a region extending from the downwardly convexedly curved portion of each of the curved sheet portions to the first end deforms in such a way as to be folded up toward the rear side, thereby breaking down a load transfer toward the front side during running.

In such a manner, a load transfer from the heel region to the forefoot region during running can be controlled more minutely and the sole structure according to the kinds of sports can thus be achieved.

The sole structure according to a fourth aspect of the present invention may be formed of a first sole structure provided at the forefoot region of the shoe and a second sole structure provided at the rear foot region of the shoe. The first sole structure may be constructed such that the first end is located on the front side of the sole structure and the second end is located on the rear side of the sole structure. The second sole structure may be constructed such that the first end is located on the rear side of the sole structure and the second end is located on the front side of the sole structure.

According to the fourth aspect of the present invention, as the weight moves from the rear side to the front side of the rear foot region of the sole structure, a region extending from the downwardly convexedly curved portion of each of the curved sheet portions to the first end deforms in such a way as to be folded up toward the rear side, thereby breaking down a load transfer in the forward direction during running. On the other hand, as the weight moves from the rear side to the front side of the forefoot region of the sole structure, a region extending from the downwardly convexedly curved portion of each of the curved sheet portions to the first end deforms in such a way as to be folded up in turn toward the front side, thereby allowing for a smooth load transfer toward the front side during running.

In such a fashion, the load transfer from the heel region to the forefoot region during running can be controlled in a more minute manner and the sole structure according to the kinds of sports can thus be achieved.

The connecting sheet portion may be provided to connect the sole structure on the forefoot region with the sole structure on the rear foot region in the longitudinal direction.

In this case, since the connecting sheet portion can prevent the upper sheet portion from sinking or going down, it lifts up and sustains an arch portion of the shoe during running to exhibit an shank effect.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale.

DETAILED DESCRIPTION OF THE PREFERRED EMBODIMENTS

Figure 1A:
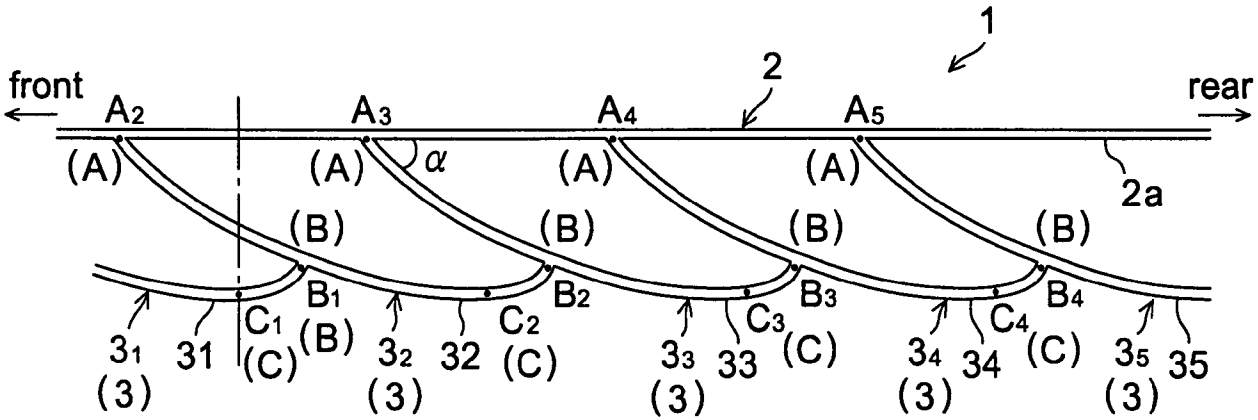
FIG. 1A is an enlarged side view of a sole structure for a shoe according to a first embodiment of the present invention.

Referring now to the drawings, FIGS. 1 to 6 show a sole structure or a sole assembly in use for a shoe according to a first embodiment of the present invention. In these drawings, like reference numbers indicate identical or functionally similar elements.

As shown in FIG. 1A, a sole structure 1 comprises an upper sheet portion 2 disposed on an upper side of the sole structure 1, and a plurality of curved sheet portions 3 ($\mathbf{3}_1$-$\mathbf{3}_5$) that are provided on a lower surface 2*a* of the upper sheet portion 2, that have downwardly convexedly curved portions 31-35, respectively, and that are disposed side by side and partially overlapped with each other in the longitudinal direction (i.e. the left to right direction of FIG. 1A).

Each of the curved sheet portions 3 ($\mathbf{3}_1$-$\mathbf{3}_5$) has a first end A ($A_1$-$A_5$) and a second end B ($B_1$-$B_5$) on the opposite sides of each of the downwardly convexedly curved portions 31-35 (in FIG. 1A, reference numerals $A_1$ and $B_5$ are not shown). The first end A ($A_1$-$A_5$) of the curved sheet portion 3 is located on the front side of the sole structure 1 and fixed to the lower surface 2*a* of the upper sheet portion 2. The second end B ($B_1$-$B_5$) of the curved sheet portion 3 is located on the rear side of the sole structure 1. At the first end A, an angle $\alpha$ of the curved sheet portion 3 relative to the rear side of the upper sheet portion 2 is preferably an acute angle. The second end B is fixed to an external surface of the adjacent curved sheet portion 3.

That is, the second end $B_1$ of the curved sheet portion $\mathbf{3}_1$ is fixed to the external surface of the curved sheet portion $\mathbf{3}_2$ adjacent to the curved sheet portion $\mathbf{3}_1$, and the second end $B_2$ of the curved sheet portion $\mathbf{3}_2$ is fixed to the external surface of the curved sheet portion $\mathbf{3}_3$ adjacent to the curved sheet portion $\mathbf{3}_2$.

Similarly, the second end $B_3$ of the curved sheet portion $\mathbf{3}_3$ is fixed to the external surface of the curved sheet portion $\mathbf{3}_4$ adjacent to the curved sheet portion $\mathbf{3}_3$, and the second end $B_4$ of the curved sheet portion $\mathbf{3}_4$ is fixed to the external surface of the curved sheet portion $\mathbf{3}_5$ adjacent to the curved sheet portion $\mathbf{3}_4$.

Also, the second end B of each of the curved sheet portions 3 is fixed to a position between the lowermost point C of the downwardly convexedly curved portions 31-35 of the adjacent curved sheet portions 3 and the first end A of the adjacent curved sheet portion 3.

That is, the second end $B_1$ of the curved sheet portions $\mathbf{3}_1$ is fixed to a position between the lowermost point $C_2$ of the downwardly convexedly curved portions 32 of the adjacent curved sheet portions $\mathbf{3}_2$ and the first end $A_2$ of the adjacent curved sheet portion $\mathbf{3}_2$, and the second end $B_2$ of the curved sheet portions $\mathbf{3}_2$ is fixed to a position between the lowermost point $C_3$ of the downwardly convexedly curved portions 33 of the adjacent curved sheet portions $\mathbf{3}_3$ and the first end $A_3$ of the adjacent curved sheet portion $\mathbf{3}_3$. The other curved sheet portions $\mathbf{3}_3$-$\mathbf{3}_5$ are similar to the above-mentioned curved sheet portions $\mathbf{3}_1$ and $\mathbf{3}_2$.

Preferably, the curved sheet portion 3 that the second end B of the adjacent curved sheet portion 3 is fixed to extends over the lowermost point C of the downwardly convexedly curved portion of the adjacent curved sheet portion 3 toward the front side.

That is, the curved sheet portion $\mathbf{3}_2$ that the second end $B_1$ of the adjacent curved sheet portion $\mathbf{3}_1$ is fixed to extends over the lowermost point $C_1$ (see a dash-and-dot line of FIG. 1A) of the downwardly convexedly curved portion 31 of the adjacent curved sheet portion $\mathbf{3}_1$ toward the front side. In other words, the first end $A_2$ of the curved sheet portion $\mathbf{3}_2$ is located in front of the lowermost point $C_1$ of the downwardly convexedly curved portion 31 of the adjacent curved sheet portion $\mathbf{3}_1$. Likewise, the curved sheet portion $\mathbf{3}_3$ that the second end $B_2$ of the adjacent curved sheet portion $\mathbf{3}_2$ is fixed to extends over the lowermost point $C_2$ of the downwardly convexedly curved portion 32 of the adjacent curved sheet portion $\mathbf{3}_2$ toward the front side. In other words, the first end $A_3$ of the curved sheet portion $\mathbf{3}_3$ is located in front of the lowermost point $C_2$ of the downwardly convexedly curved portion 32 of the adjacent curved sheet portion $\mathbf{3}_2$. The other curved sheet portions $\mathbf{3}_3$-$\mathbf{3}_5$ are similar to the above-mentioned curved sheet portions $\mathbf{3}_1$ and $\mathbf{3}_2$.

Preferably, the upper sheet portion 2 and the curved sheet portions $\mathbf{3}_1$-$\mathbf{3}_5$ are integrally formed with each other using resin. As resin materials, for example, thermoplastic resin such as thermo plastic polyurethane (TPU), polyamide elastomer (PAE) and the like are used. Thermosetting resin such as epoxy resin, unsaturated polyester resin and the like are also used. Furthermore, it is also possible to form the upper sheet portion 2 and the curved sheet portions $\mathbf{3}_1$-$\mathbf{3}_5$ integrally with each other using ethylene-vinyl acetate copolymer (EVA), rubber or the like. In addition, the upper sheet portion 2 and the curved sheet portions $\mathbf{3}_1$-$\mathbf{3}_5$ may be formed in a separate process and thereafter they may be bonded to each other using an adhesive agent or the like.

Figure 1B:
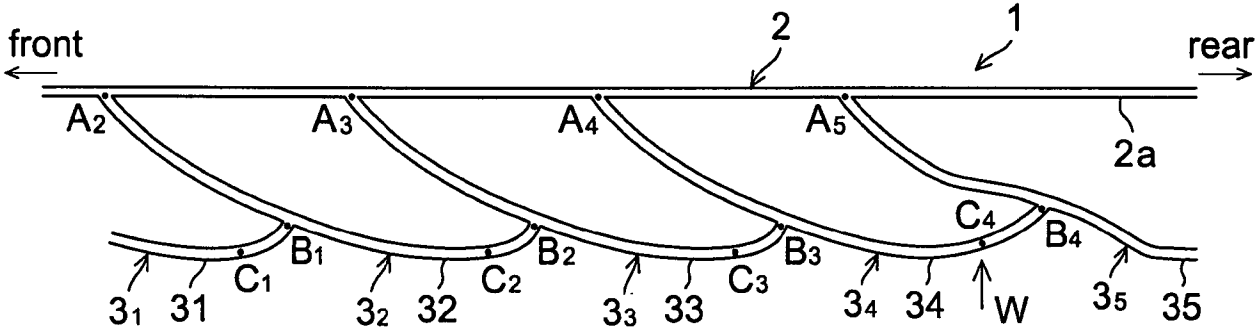
FIG. 1B illustrates a state in which a compressive load is applied to a portion of the sole structure of FIG. 1A.

At the time of a strike of the sole structure onto the ground, when a compressive load W is imparted to any of the curved sheet portions (e.g. the curved sheet portion $\mathbf{3}_4$) as shown in FIG. 1B, the downwardly convexedly curved portion 34 of the curved sheet portion $3_4$ deforms compressively to absorb an impact load. Also, at this juncture, the second end $B_4$ of the curved sheet portion $3_4$ presses against and compressively deform the externals surface of the adjacent curved sheet portion $3_5$(see FIG. 1B).

In this way, a compressive deformation of any of the curved sheet portions causes a compressive deformation of the adjacent curved sheet portion on the rear side, thereby improving the cushioning properties of the entire sole structure.

Also, in this case, because the fixed positions of the second ends $B_1$-$B_5$ of the curved sheet portions $3_1$-$3_5$ are located between the lowermost positions $C_1$-$C_5$ of the downwardly convexedly curved portions 31-35 of the adjacent curved sheet portions $3_1$-$3_5$ and the first ends $A_1$-$A_5$ of the adjacent curved sheet portions $3_1$-$3_5$, when the second ends $B_1$-$B_5$ of the curved sheet portions $3_1$-$3_5$ that have been compressively deformed push against the external surfaces of the adjacent curved sheet portions $3_1$-$3_5$, the deformation of each of the adjacent curved sheet portions $3_1$-$3_5$ is facilitated, thus further enhancing the cushioning properties of the entire sole structure.

Moreover, in a case like this, since the adjacent curved sheet portions $3_1$-$3_5$ that the second ends $B_1$-$B_5$ of the curved sheet portions $3_1$-$3_5$ are respectively fixed to extend over the lowermost points $C_1$-$C_5$ of the downwardly convexedly curved sheet portions 31-35 of the adjacent curved sheet portions $3_1$-$3_5$ the load that has been imparted to the lowermost points $C_1$-$C_5$ of the downwardly convexedly curved portions 31-35 of the curved sheet portions $3_1$-$3_5$ can be sustained by at least two curved sheet portions including the adjacent curved sheet portion, thus improving the shock absorbing ability.

Figure 1C:
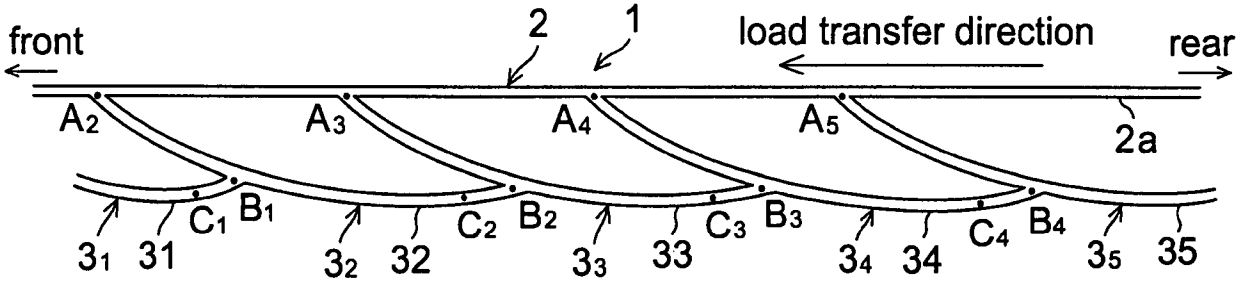
FIG. 1C illustrates a deformed state of the sole structure of FIG. 1A during running.

After a shoe impact onto the ground, as the load is transferred in the forward direction (i.e. the left direction in FIG. 1B), the regions extending from the downwardly convexly curved portions 31-35 of the curved sheet portions $3_1$-$3_5$ to the first ends $A_1$-$A_5$, respectively, deform in such a way as to be folded up in turn toward the front side (see FIG. 1C). As a result, a smooth load transfer in the forward direction during running can be achieved and a ride feeling during running can thus be improved.

Figure 2:
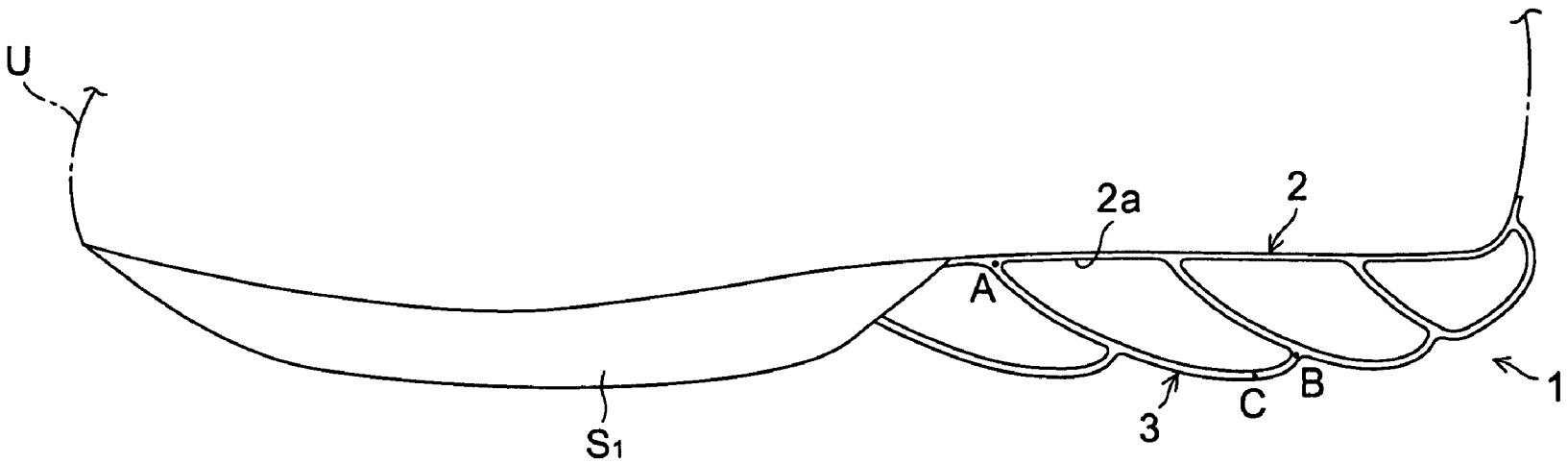
FIG. 2 is a side view of a portion of a shoe whose heel region employs the sole structure of FIG. 1A.
Figure 3:
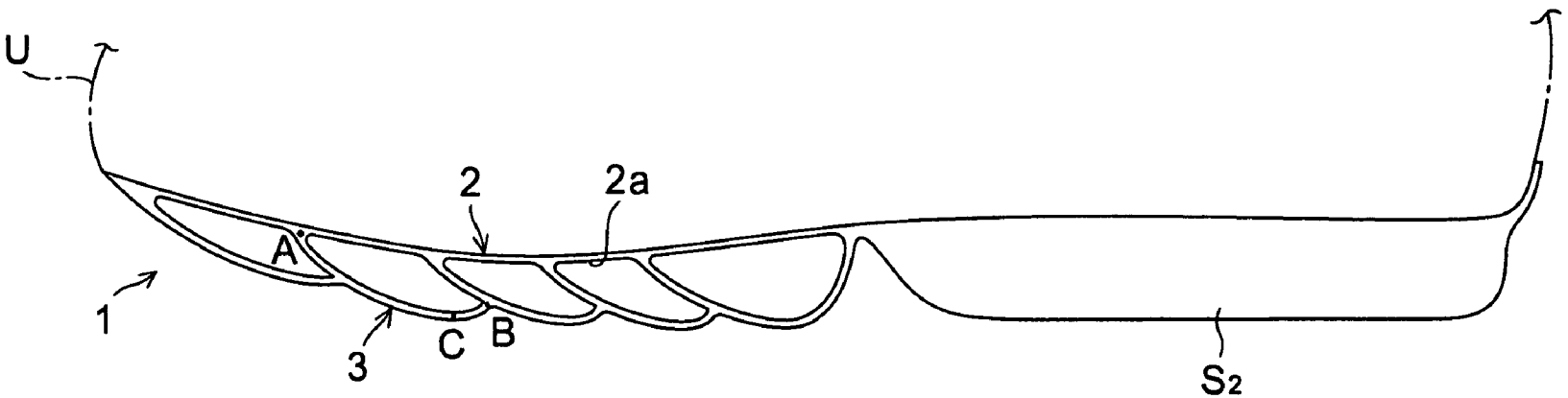
FIG. 3 is a side view of a portion of a shoe whose forefoot region employs the sole structure of FIG. 1A.
Figure 4:
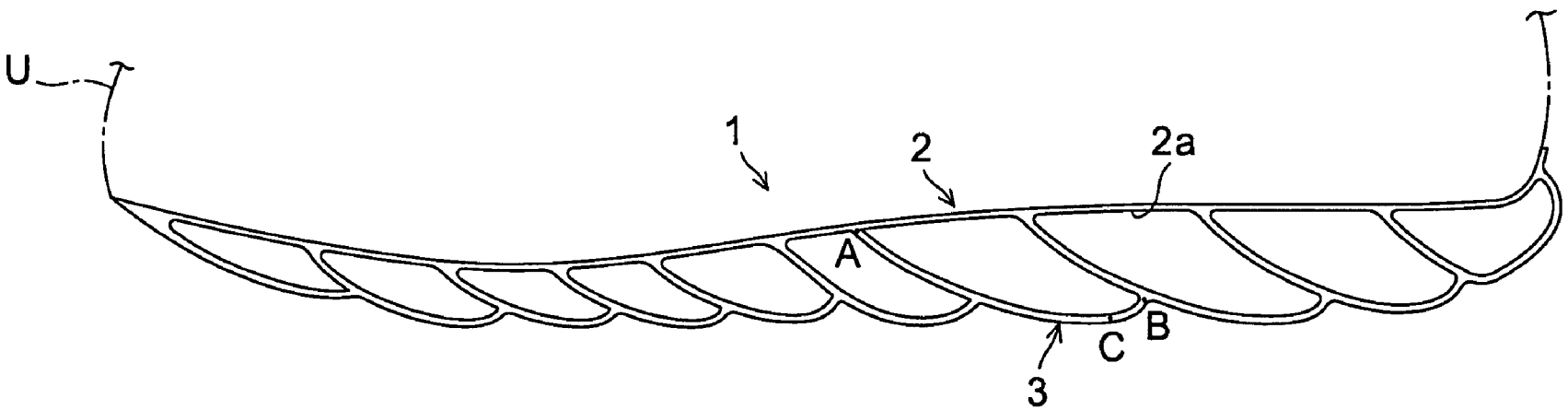
FIG. 4 is a side view of a portion of a shoe whose entire sole surface employs the sole structure of FIG. 1A.
Figure 5:
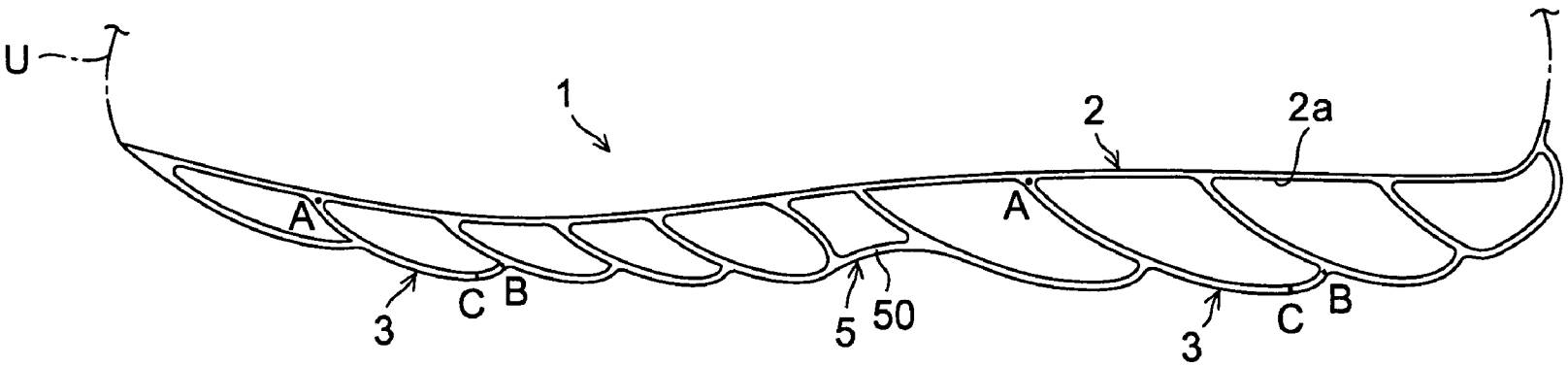
FIG. 5 is a side view of a portion of a shoe whose heel to forefoot regions employ the sole structure of FIG. 1A and where a discontinuity portion is provided at a part of the heel to forefoot regions.
Figure 6:
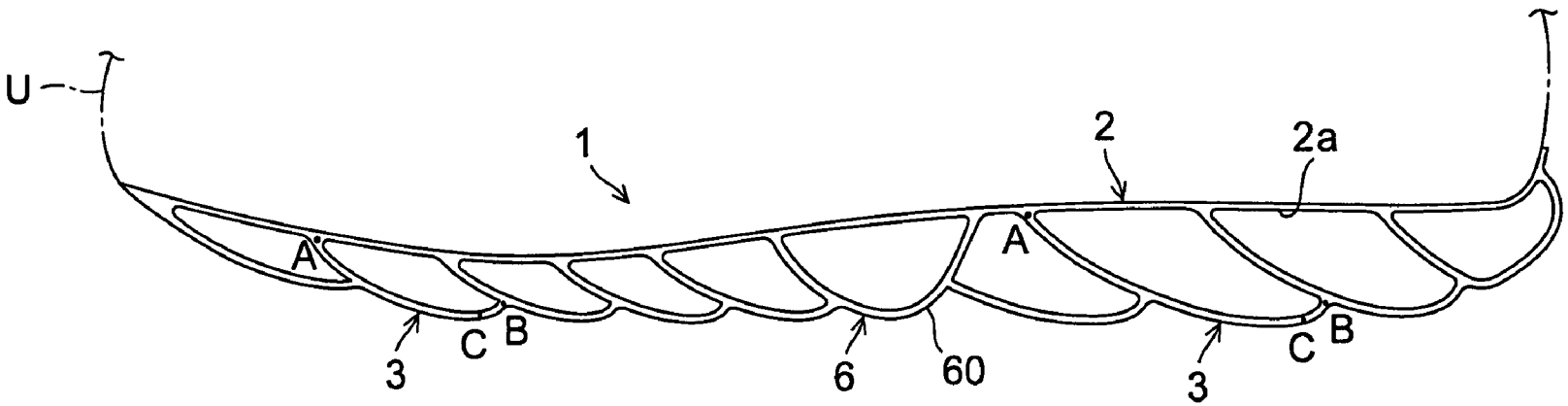
FIG. 6 is a side view of a portion of a shoe whose heel to forefoot regions employ the sole structure of FIG. 1A and where a discontinuity portion is provided at a part of the heel to forefoot regions.

FIGS. 2 to 6 show exemplified embodiments in which the sole structure of the first embodiment of the present invention is applied to an actual shoe. FIGS. 2 to 6 are side views of a portion of a shoe. FIGS. 2 to 4 show the embodiments in which the sole structure is applied to a heel region, a forefoot region, and a sole entire surface of the shoe, respectively. FIGS. 5 and 6 show the embodiments in which the sole structure is applied to the heel region to the forefoot region of the shoe and discontinuity is also provided at a part of the sole structure. In these drawings, reference numerals $S_1$ and $S_2$ designate a general sole formed of a soft elastic member such as foamed resin or the like. Reference numeral U designates an upper whose lower portion is fixedly attached to the sole structure.

As shown in FIG. 2, in the event that the sole structure 1 is applied to the heel region of the shoe, a compressive deformation of the heel region is facilitated and the cushioning properties can thus be improved. At the same time, a smooth load transfer in the forward direction at the heel region is achieved and the ride feeling can thus be improved.

As shown in FIG. 3, in the event that the sole structure 1 is applied to the forefoot region of the shoe, a compressive deformation of the forefoot region is facilitated and the cushioning properties can thus be improved. At the same time, a smooth load transfer in the forward direction at the forefoot region is achieved and the ride feeling can thus be improved.

As shown in FIG. 4, in the event that the sole structure 1 is applied to the entire sole surface of the shoe, a compressive deformation of the entire sole surface is facilitated and the cushioning properties can thus be improved. At the same time, a smooth load transfer in the forward direction at the entire sole surface extending from the heel region to the toe is achieved and the ride feeling can thus be improved.

As shown in FIGS. 5 and 6, in the event that the sole structure 1 is applied to the heel region to the forefoot region of the shoe and discontinuities 5, 6 are provided at a part of the sole structure 1, as the weight moves from the heel region to the forefoot region of the sole structure 1 through the discontinuities 5, 6, from the heel region to the discontinuities 5, 6, a region extending from the downwardly convexedly curved portion of each of the curved sheet portions 3 to the first end A deforms in such a way as to be folded up in turn toward the front side, and a smooth load transfer in the forward direction during running can thus be achieved, but at the discontinuities 5, 6, the deformation of the curved sheet portion 3 is restricted, thereby breaking down the load transfer in the forward direction during running. Thereafter, as the weight moves from the discontinuities 5, 6 to the forefoot region, a region extending from the downwardly convexedly curved portion of each of the curved sheet portions 3 to the first end A deforms in such a way as to be folded up in turn toward the front side, and a smooth load transfer in the forward direction during running can thus be achieved.

In such a manner, the load transfer during running at the heel region to the forefoot region can be minutely controlled and the sole structure according to the kinds of sports can be achieved.

The discontinuity 5 in the embodiment is formed of a connecting sheet portion 50, which is upwardly convexedly curved portion or a flat-shaped portion interposed between and connecting the adjacent curved sheet portions 3 with each other. The discontinuity 6 in the embodiment is formed of a downwardly convexedly curved portion that is interposed between the adjacent curved sheet portions 3, that connects the adjacent curved sheet portions 3, and that is fixedly attached to the upper sheet portion 2 at the opposite ends of the discontinuity 6.

Figure 7A:
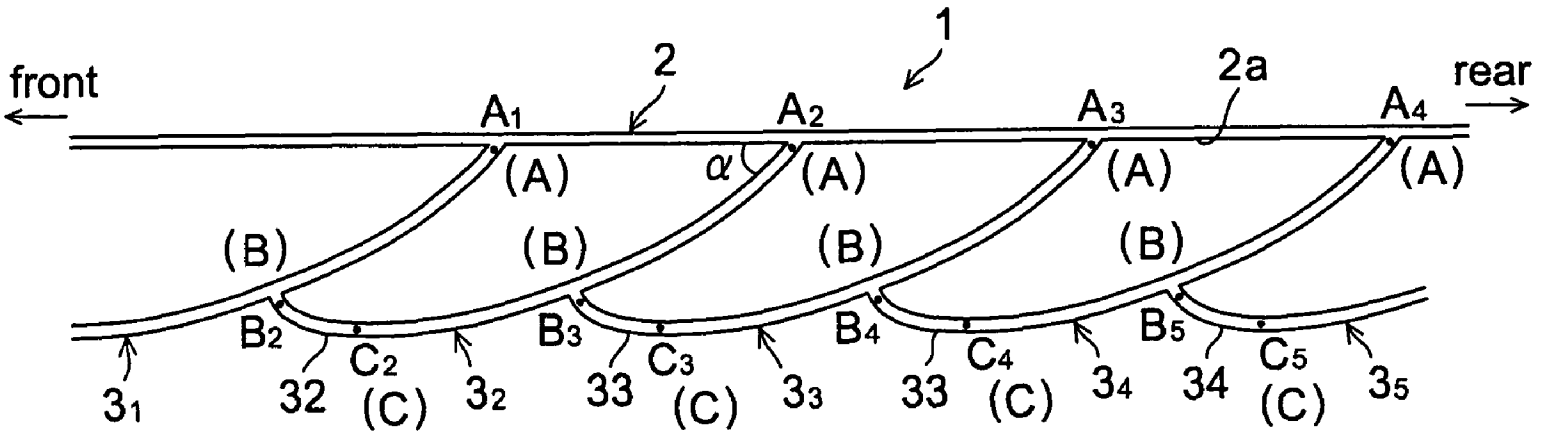
FIG. 7A is an enlarged side view of a sole structure for a shoe according to a second embodiment of the present invention.
Figure 7B:
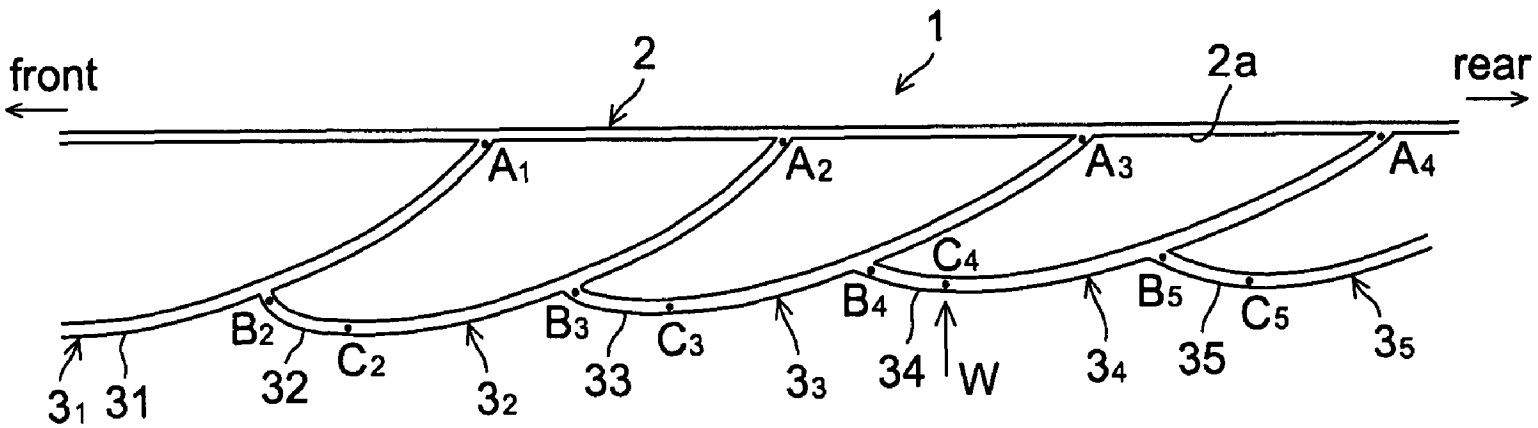
FIG. 7B illustrates a state in which a compressive load is applied to a portion of the sole structure of FIG. 1A.
Figure 8:
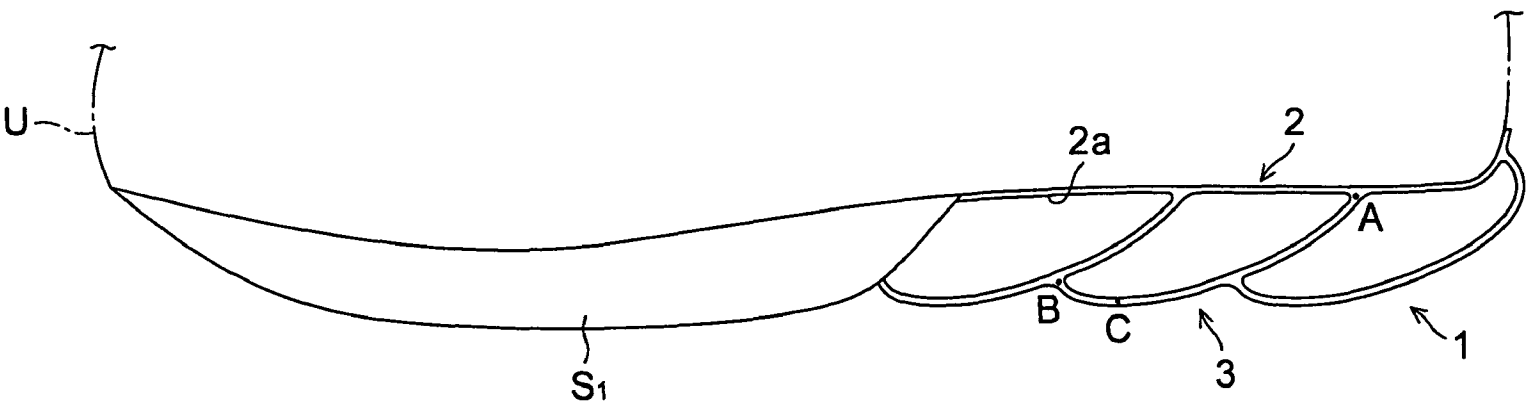
FIG. 8 is a side view of a portion of a shoe whose heel region employs the sole structure of FIG. 7A.
Figure 9:
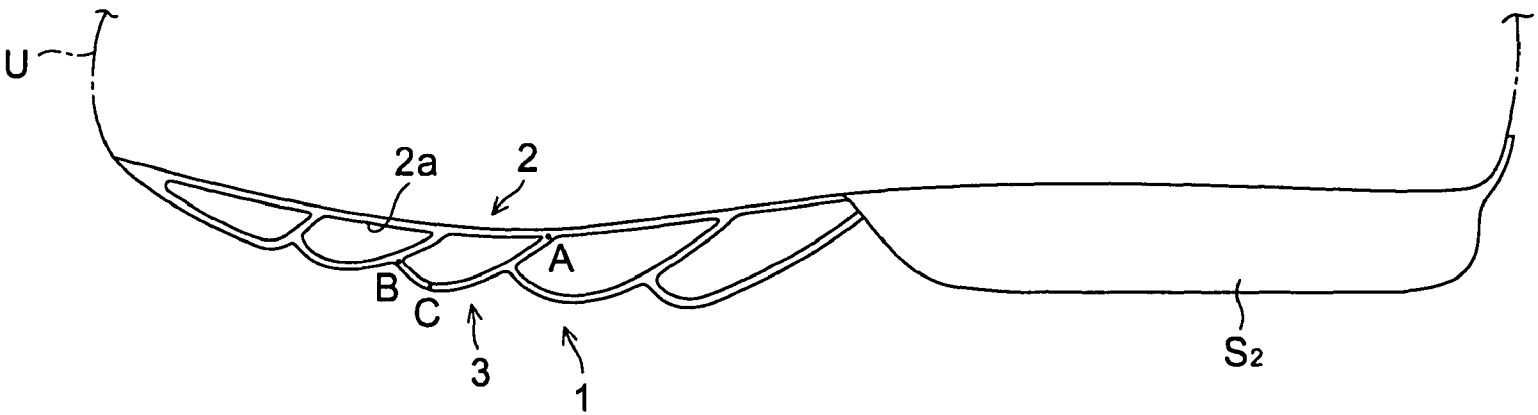
FIG. 9 is a side view of a portion of a shoe whose forefoot region employs the sole structure of FIG. 7A.

FIGS. 7 to 9 show a sole structure or a sole assembly in use for a shoe according to a second embodiment of the present invention. FIGS. 7A and 7B are enlarged side views of the sole structure. FIG. 8 shows an embodiment in which the sole structure of FIG. 7 is applied to the heel region of the shoe. FIG. 9 shows an embodiment in which the sole structure of FIG. 7 is applied to the forefoot region of the shoe. In these drawings, like reference numbers indicate identical or functionally similar elements.

The second embodiment is similar to the first embodiment in that as shown in FIG. 7A the sole structure 1 is comprised of the upper sheet portion 2 disposed on the upper side and a plurality of curved sheet portions 3 ($3_1$-$3_5$) that are provided on the lower surface 2*a* of the upper sheet portion 2, that have downwardly convexedly curved portions 31-35, respectively, that are disposed alongside of each other, and that are partially overlapped with each other. However, the second embodiment differs from the first embodiment in that the first ends A ($A_1$-$A_5$) of the curved sheet portions 3 are located at the rear of the sole structure 1 and the second ends B ($B_1$-$B_5$) of the curved sheet portions 3 are located in front of the sole structure 1.

At the time of a strike of the sole structure onto the ground, when a compressive load W is imparted to any of the curved sheet portions (e.g. the curved sheet portion $3_4$) as shown in FIG. 7B, the downwardly convexedly curved portion 34 of the curved sheet portion $3_4$ deforms compressively to absorb an impact load. Also, at this juncture, the second end $B_4$ of the curved sheet portion $3_4$ presses against and compressively deform the externals surface of the adjacent curved sheet portion $3_3$ (see FIG. 1B).

In this way, a compressive deformation of any of the curved sheet portions causes a compressive deformation of the adjacent curved sheet portion on the front side, thereby improving the cushioning properties of the entire sole structure.

Also, in this case, because the fixed positions of the second ends $B_1$-$B_5$ of the curved sheet portions $3_1$-$3_5$ are located between the lowermost points $C_1$-$C_5$ of the downwardly convexedly curved portions 31-35 of the adjacent curved sheet portions $3_1$-$3_5$ and the first ends $A_1$-$A_5$ of the adjacent curved sheet portions $3_1$-$3_5$, when the second ends $B_1$-$B_5$ of the curved sheet portions $3_1$-$3_5$ that have been compressively deformed pushes against the external surfaces of the adjacent curved sheet portions $3_1$-$3_5$, the deformation of each of the adjacent curved sheet portions $3_1$-$3_5$ is facilitated, thus further enhancing the cushioning properties of the entire sole structure.

Moreover, in a case like this, since the adjacent curved sheet portions $3_1$-$3_5$ that the second ends $B_1$-$B_5$ of the curved sheet portions $3_1$-$3_5$ are respectively fixed to extend over the lowermost points $C_1$-$C_5$ of the downwardly convexedly curved sheet portions 31-35 of the curved sheet portions $3_1$-$3_5$ the load that has been imparted to the lowermost points $C_1$-$C_5$ of the downwardly convexedly curved portions 31-35 of the curved sheet portions $3_1$-$3_5$ can be sustained by at least two curved sheet portions including the adjacent curved sheet portion, thus improving the shock absorbing ability.

After a shoe impact onto the ground, as the load is transferred in the forward direction (i.e. the left direction in FIG. 7B), the regions extending from the downwardly convexly curved portions 31-35 of the curved sheet portions $3_1$-$3_5$ to the first ends $A_1$-$A_5$, respectively, deform in such a way as to be folded up toward the rear side (see FIG. 7B), thereby breaking down the load transfer toward the front side during running and the load transfer in the forward direction can thus be controlled.

FIGS. 8 and 9 show exemplified embodiments in which the sole structure of the second embodiment of the present invention is applied to an actual shoe. FIGS. 8 and 9 are side views of a portion of a shoe. FIGS. 8 and 9 show the embodiments in which the sole structure is applied to a heel portion and a forefoot portion, of the shoe, respectively. In these drawings, reference numerals $S_1$ and $S_2$ designate a general sole formed of a soft elastic member such as foamed resin or the like. Reference numeral U designates an upper whose lower portion is fixedly attached to the sole structure.

As shown in FIG. 8, in the event that the sole structure 1 is applied to the heel region of the shoe, the heel region compressively deforms with ease, thereby improving the cushioning properties. At the same time, a load transfer of the heel region toward the front side during running can be broken down, thereby controlling the load transfer in the forward direction.

As shown in FIG. 9, in the event that the sole structure 1 is applied to the forefoot region of the shoe, the forefoot region compressively deforms with ease, thereby improving the cushioning properties. At the same time, a load transfer of the forefoot region toward the front side during running can be broken down, thereby controlling the load transfer in the forward direction.

Additionally, the sole structure 1 may be applied to the entire sole surface of the shoe (not shown). In this case, a compressive deformation of the entire sole surface is facilitated and the cushioning properties can thus be improved. At the same time, a load transfer of the entire sole surface from the heel region to the toe toward the front side can be broken down and the load transfer in the forward direction is controllable. Also, the sole structure 1 may be provided at the heel region to the forefoot region of the shoe and a discontinuity may be provided at a part of the sole structure 1.

In this manner, the load transfer at the heel region to the forefoot region during running can be minutely controlled and the sole structure according to the kinds of sports can be achieved.

Figure 10:
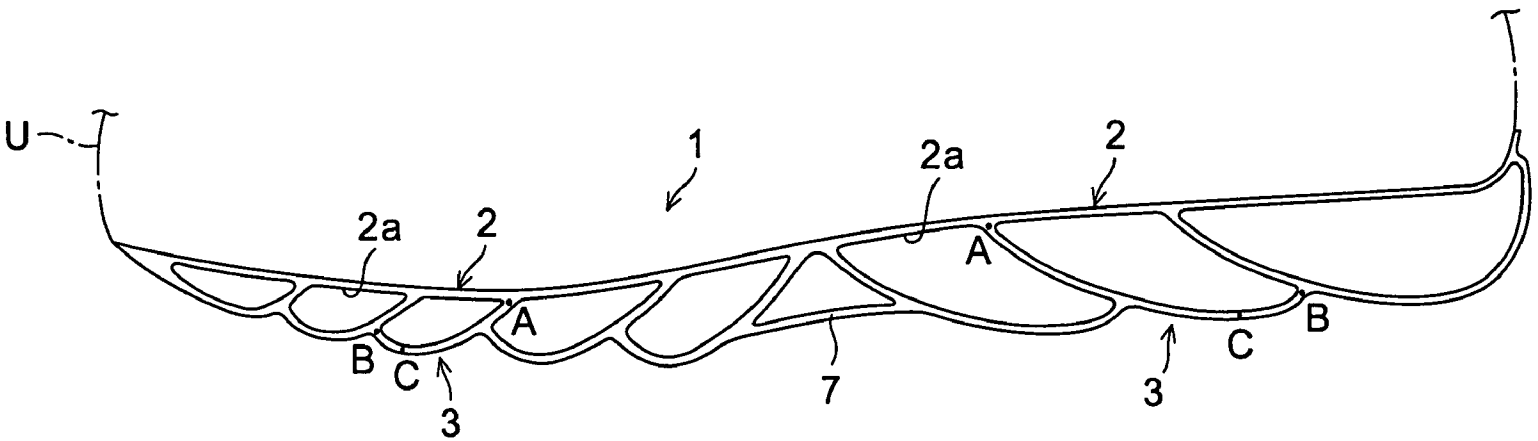
FIG. 10 is a side view of a portion of a shoe whose rear foot region employs the sole structure of the first embodiment of the present invention and whose forefoot region employs the sole structure of the second embodiment of the present invention.
Figure 11:
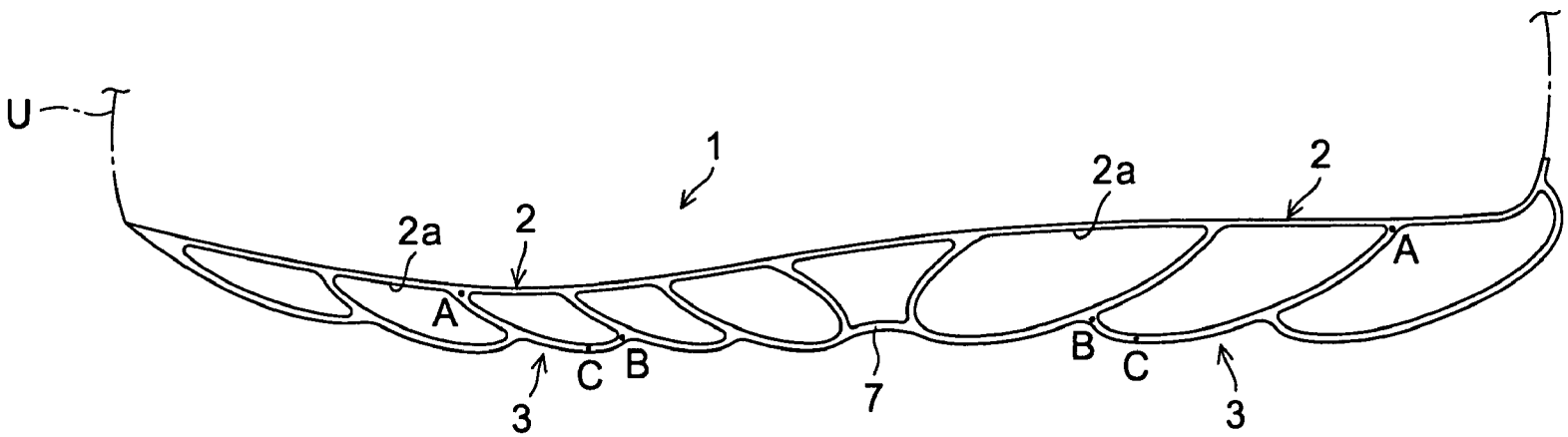
FIG. 11 is a side view of a portion of a shoe whose rear foot region employs the sole structure of the second embodiment of the present invention and whose forefoot region employs the sole structure of the first embodiment of the present invention.

FIGS. 10 and 11 show a third embodiment of the present invention that is a combination of the first and second embodiments. In FIG. 10, the sole structure of the first embodiment is provided at the rear foot region of the shoe and the sole structure of the second embodiment is provided at the forefoot region of the shoe. In FIG. 11, the sole structure of the second embodiment is provided at the rear foot region of the shoe and the sole structure of the first embodiment is provided at the forefoot region of the shoe. In these drawings, like reference numbers indicate identical or functionally similar elements.

In the event that the sole structure 1 of the first embodiment is provided at the rear foot region of the shoe and the sole structure 1 of the second embodiment is provided at the forefoot region of the shoe as shown in FIG. 10, as the weight moves from the rear side to the front side at the rear foot region of the sole structure 1, a region from the downwardly convexedly curved portions of the curved sheet portion 3 to the first end A deforms in such a way as to be folded up in turn toward the front side and a smooth load transfer in the forward direction during running can thus be achieved. On the other hand, at the forefoot region of the sole structure 1, as the weight moves from the rear side to the front side, a region from the downwardly convexedly curved portions of the curved sheet portion 3 to the first end A deforms in such a way as to be folded up toward the rear side, thus breaking down the load transfer toward the front side during running.

In this way, the load transfer at the rear foot region to the forefoot region during running can be minutely controlled and the sole structure in accordance with sports can be achieved.

In the event that the sole structure 1 of the second embodiment is provided at the rear foot region of the shoe and the sole structure 1 of the first embodiment is provided at the forefoot region of the shoe as shown in FIG. 11, as the weight moves from the rear side to the front side at the rear foot region of the sole structure 1, a region from the downwardly convexedly curved portions of the curved sheet portion 3 to the first end A deforms in such a way as to be folded up toward the rear side, thereby breaking down a load transfer toward the front side during running. On the other hand, at the forefoot region of the sole structure 1, as the weight moves from the rear side to the front side, a region from the downwardly convexedly curved portions of the curved sheet portion 3 to the first end A deforms in such a way as to be folded up in turn toward the front side, thus allowing for a smooth load transfer in the forward direction during running.

In this way, the load transfer at the rear foot region to the forefoot region during running can be controlled in a minute manner and the sole structure in accordance with sports can be achieved.

Also, the sole structure 1 on the forefoot side and the sole structure 1 on the rear foot side are interconnected to each other via the connecting sheet part 7 in the longitudinally direction.

In this case, the connecting part 7 can prevent the upper sheet portion 2 from sinking or going downwardly, thus sustaining a plantar arch portion of the shoe upwardly during running to exhibit a shank effect.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet fall within the scope of the invention.

What is claimed is:

1. A sole structure for a shoe comprising:

an upper sheet; and a plurality of curved sheet members that each comprise a downwardly convexly curved sheet element, and that are arranged adjacent one another and partially overlapping one another in a longitudinal direction of said sole structure;

wherein an upper end of each respective one of the curved sheet members is joined to a lower surface of the upper sheet, and a lower end of each respective one of the curved sheet members is joined at a junction point to a downwardly facing surface of an adjacent one of the curved sheet members that is adjacent to and partially overlapped by the respective one of the curved sheet members, and wherein each one of the curved sheet members further has at least one of the following features:

a first feature wherein each one of the curved sheet members consists of said downwardly convexly curved sheet element which is a single continuously downwardly convexly curved sheet element extending from said upper end to said lower end, a second feature wherein the downwardly facing surface of each one of the curved sheet members has a downwardly convexly curved shape at a lowermost point of the curved sheet member, a third feature wherein the junction point at which the lower end of each respective one of the curved sheet members is joined to the downwardly facing surface of the adjacent curved sheet member is higher than a lowermost point of the respective sheet member.

2. The sole structure according to claim 1, wherein each one of the curved sheet members has said first feature.

3. The sole structure according to claim 2, wherein each one of the curved sheet members has said second feature.

4. The sole structure according to claim 3, wherein each one of the curved sheet members has said third feature.

5. The sole structure according to claim 2, wherein each one of the curved sheet members has said third feature.

6. The sole structure according to claim 1, wherein each one of the curved sheet members has said third feature.

7. The sole structure according to claim 1, wherein each one of the curved sheet members has said second feature.

8. The sole structure according to claim 1, wherein each one of the curved sheet members has said second feature.

9. The sole structure according to claim 1, wherein the sole structure does not include a smooth flat continuous bottom sheet.

10. The sole structure according to claim 1, wherein each one of the curved sheet members respectively excludes a downwardly facing concave surface portion.

11. The sole structure according to claim 1, wherein each one of the curved sheet members respectively does not have an S-shape.

12. The sole structure according to claim 1, wherein portions of said downwardly facing surfaces respectively between said lower end and said junction point of each respective one of said curved sheet members together form a bottom surface of the sole structure, which has upwardly recessed troughs at the junction points.

13. The sole structure according to claim 1, wherein the lower end of each of the curved sheet members is located at a position in the longitudinal direction between a lowermost point of the downwardly facing surface of the adjacent curved sheet member and the upper end of the adjacent curved sheet member.

14. The sole structure according to claim 1, wherein a portion of the downwardly facing surface of the adjacent curved sheet member between the junction point and the upper end thereof extends over the lowermost point of the downwardly facing surface of the respective curved sheet member.

15. The sole structure according to claim 1, wherein the sole structure is constructed such that when a load is applied to a bottom of the sole structure then the curved sheet members compressively deform and the lower end of a compressively deformed curved sheet member presses against and compressively deforms a respective adjacent one of the curved sheet members.

16. The sole structure according to claim 1, wherein the upper end of a respective curved sheet member is located toward a front end of the sole structure and the lower end of the respective curved sheet member is located toward a rear end of the sole structure.

17. The sole structure according to claim 16, wherein the sole structure is provided at a heel region to a forefoot region of the shoe and a discontinuity is provided at a part of the sole structure between the heel region and the forefoot region.

18. The sole structure according to claim 17, wherein the discontinuity comprises a connecting sheet that connects the sole structure at the forefoot region with the sole structure at the heel region in the longitudinal direction.

19. The sole structure according to claim 1, wherein the upper end of a respective curved sheet member is located toward a rear end of the sole structure and the lower end of the respective curved sheet member is located toward a front end of the sole structure.

20. The sole structure according to claim 19, wherein the sole structure is provided at a heel region to a forefoot region of the shoe and a discontinuity is provided at a part of the sole structure between the heel region and the forefoot region.

21. The sole structure according to claim 20, wherein the discontinuity comprises a connecting sheet that connects the sole structure at the forefoot region with the sole structure at the heel region in the longitudinal direction.

22. A sole construction comprising a combination of two of the sole structures according to claim 1, including a first said sole structure provided at a rear foot region and a second said sole structure provided at a forefoot region, wherein in the first sole structure the upper end of each of the curved sheet members is located toward a front end of the first sole structure and the lower end of each of the curved sheet members is located toward a rear end of the first sole structure, and in the second sole structure the upper end of each of the curved sheet members is located toward a rear end of the second sole structure and the lower end of each of the curved sheet members is located toward a front end of the second sole structure.

23. The sole construction according to claim 22, further comprising a connecting sheet that connects the first sole structure with the second sole structure in the longitudinal direction.

24. A sole construction comprising a combination of two of the sole structures according to claim 1, including a first said sole structure provided at a forefoot region and a second said sole structure provided at a rear foot region, wherein in the first sole structure the upper end of each of the curved sheet members is located toward a front end of the first sole structure and the lower end of each of the curved sheet members is located toward a rear end of the first sole structure, and in the second sole structure the upper end of each of the curved sheet members is located toward a rear end of the second sole structure and the lower end of each of the curved sheet members is located toward a front end of the second sole structure.

25. The sole construction according to claim 24, further comprising a connecting sheet that connects the first sole structure with the second sole structure in the longitudinal direction.

* * * * *

UNITED STATES PATENT AND TRADEMARK OFFICE

CERTIFICATE OF CORRECTION

PATENT NO. : 8,215,031 B2
APPLICATION NO. : 12/380462
DATED : July 10, 2012
INVENTOR(S) : Takaya Kimura et al.

It is certified that error appears in the above-identified patent and that said Letters Patent is hereby corrected as shown below:

Column 13,
Line 64, claim 7, after "claim", replace "1" by --6--.

Signed and Sealed this
Twelfth Day of March, 2013

Teresa Stanek Rea
*Acting Director of the United States Patent and Trademark Office*